US010450697B2

(12) United States Patent
Petra et al.

(10) Patent No.: US 10,450,697 B2
(45) **Date of Patent: *Oct. 22, 2019**

(54) SPACE FRAME RADOME COMPRISING A POLYMERIC SHEET

(71) Applicant: DSM IP ASSETS B.V., Heerlen (NL)

(72) Inventors: Danielle Geertruda Irene Petra, Echt (NL); William Adrianus Cornelis Roovers, Echt (NL); Lewis Kolak, Echt (NL)

(73) Assignee: DSM IP ASSETS B.V., Heerlen (NL)

( * ) Notice: Subject to any disclaimer, the term of this patent is extended or adjusted under 35 U.S.C. 154(b) by 196 days.

This patent is subject to a terminal disclaimer.

(21) Appl. No.: 15/511,345

(22) PCT Filed: Sep. 15, 2015

(86) PCT No.: PCT/EP2015/071087
§ 371 (c)(1),
(2) Date: Mar. 15, 2017

(87) PCT Pub. No.: WO2016/041954
PCT Pub. Date: Mar. 24, 2016

(65) Prior Publication Data

US 2017/0284017 A1 Oct. 5, 2017

Related U.S. Application Data

(60) Provisional application No. 62/051,084, filed on Sep. 16, 2014.

(30) Foreign Application Priority Data

Feb. 10, 2015 (EP) ..... 15154424

(51) Int. Cl.

| | |
|---|---|
| ***D06N 3/04*** | (2006.01) |
| ***D06N 3/00*** | (2006.01) |
| ***D06M 15/227*** | (2006.01) |
| ***H01Q 1/42*** | (2006.01) |
| *D06M 101/20* | (2006.01) |

(52) U.S. Cl.
CPC ..... *D06N 3/045* (2013.01); *D06M 15/227* (2013.01); *D06N 3/0038* (2013.01); *H01Q 1/42* (2013.01); *D06M 2101/20* (2013.01); *D06M 2200/12* (2013.01); *D06N 2209/048* (2013.01)

(58) Field of Classification Search
CPC ..... D06M 15/227; D06M 2101/20; D06M 2200/12; D06N 2209/048; D06N 3/0038; D06N 3/045; H01Q 1/42
See application file for complete search history.

(56) References Cited

U.S. PATENT DOCUMENTS

| | | | | |
|---|---|---|---|---|
| 4,946,736 | A | 8/1990 | Sassa | |
| 2014/0327595 | A1* | 11/2014 | Van Oosterbosch | B29C 70/04 343/872 |
| 2015/0033936 | A1* | 2/2015 | Cummins | B32B 5/02 89/36.02 |
| 2016/0178327 | A1* | 6/2016 | Beard | B29C 70/42 428/113 |

FOREIGN PATENT DOCUMENTS

| | | | |
|---|---|---|---|
| CN | 1031050 | 2/1989 | |
| EP | 2 042 414 | 9/1980 | |
| EP | 2 051 667 | 1/1981 | |
| EP | 0 200 547 | 11/1986 | |
| EP | 0 205 960 | 12/1986 | |
| EP | 0 213 208 | 3/1987 | |
| EP | 0302596 | 2/1989 | |
| EP | 0 472 114 | 4/1999 | |
| EP | 1 350 868 | 10/2003 | |
| WO | WO 01/73173 | 10/2001 | |
| WO | WO 2005/066401 | 7/2005 | |
| WO | WO 2009/075961 | 6/2009 | |
| WO | WO 2011/045321 | 4/2011 | |
| WO | WO 2012/000126 | 5/2012 | |
| WO | WO 2012/126885 | 9/2012 | |
| WO | WO-2013131996 A1 * | 9/2013 | B32B 5/02 |
| WO | WO 2014/140260 | 9/2014 | |

OTHER PUBLICATIONS

International Search Report for PCT/EP2015/071087, dated Dec. 8, 2015, three (3) pages.
Clarke et al., "Fabry-Perot and open resonators at microwave and millimetre wave frequencies, 2-300 GHz", *J. Phys., E: Sci., Instrum*, vol. 15, 1982, pp. 9-24.
Clarke et al., "A Guide to characterization of dielectric materials at RF and microwave frequencies", *National Physical Laboratory*, 2003, 187 pages.
P. Smith, "Technical fabric structures-3. Nonwoven fabrics", Handbook of Technical Textiles—Chapter 6, 2000, 22 pages.
W. Sondhelm, "Technical fabric structures-1. Woven fabrics", Handbook of Technical Textiles—Chapter 4, 2000, 33 pages.
S. Anand, "Technical fabric structures-2. Knitted fabrics", Handbook of Technical Textiles—Chapter 5, 2000, 22 pages.
S. Ogin, "Textile-reinforced composite materials", Handbook of Technical Textiles—Chapter 11, 2000, 18 pages.
H. G. Karian, "Metallocense Plastomers", Handbook of Polypropylene Composites—Chapter 7, subchapters 7.2, 7.2.2., 7.2.5 and 7.2.7, 7 pages.

* cited by examiner

*Primary Examiner* — Arti Singh-Pandey
(74) *Attorney, Agent, or Firm* — Nixon & Vanderhye P.C.

(57) ABSTRACT

The invention relates to a space frame radome comprising a sheet, said sheet comprising high strength polymeric fibers and a plastomer, wherein said plastomer is a copolymer of ethylene or propylene and one or more C2 to C12 alpha-olefin co-monomers and wherein said plastomer has a density as measured according to ISO1183 of between 860 and 940 kg/m$^3$ and wherein the sheet has an areal density that is with at most 500% higher than the areal density of the high strength polymeric fibers.

17 Claims, No Drawings

SPACE FRAME RADOME COMPRISING A POLYMERIC SHEET

This application is the U.S. national phase of International Application No. PCT/EP2015/071087 filed Sep. 15, 2015 which designated the U.S. and claims the benefit of U.S. Provisional Application No. 62/051,084 filed Sep. 16, 2014 and claims priority to EP Patent Application No. 15154424.4 filed Feb. 10, 2015, the entire contents of each of which are hereby incorporated by reference.

The present invention relates to a space frame radome comprising a polymeric sheet. Moreover, the present invention relates to a process to manufacture a space frame radome by using said sheet. The present invention also relates to a system comprising an antenna and a space frame radome comprising said sheet. Furthermore, the invention relates to the use of said sheet in a space frame radome.

Radomes are highly electromagnetically transparent structures used for covering or enclosing and protecting antennas and satellite communications (SATCOM) antennas. Antennas used in e.g. radar installations, wireless telecom infrastructure and radio telescopes often need a radome or a covering structure of some kind to protect them from weather, e.g. sunlight, wind and moisture. The presence of the radome is particularly mandatory for antennas placed in regions where high winds or storms often occur, in order to protect the antennas from hale and impacts from projectiles such as debris carried by the wind. Radomes are generally made of either rigid self-supporting materials or air-inflated flexible fabrics. Different types of radomes including dielectric, space frame, composite, and air inflatable radomes are already known in the art. Inflatable radomes are typically made of air-inflated flexible electrically thin dielectric cloth. However, the inflatable radomes having walls made of air-inflated flexible fabrics require a constant supply of air, supplied by air blowers or air compressors from inside. They also require airlocks at all doors and a stand-by power supply to operate the blowers at all times and under all environmental conditions. Should the membrane suffer damage or if power is interrupted the radome can potentially collapse. Operating and maintenance cost for inflatable radomes usually exceeds all other types.

A known special kind of radome is a space frame radome, that has a rigid self-supporting structure and is the most commonly used radome in severe weather locations. Therefore, the space frame radome should show high weatherproof and retain high transparency to the electromagnetic waves emitted and received by the radar equipment. The stresses that these radomes can undergo should be very strong because the radomes must resist to very adverse environmental conditions, for example wind velocities of the order of hundreds km/h, violent hails, high temperatures and so on. Therefore, the space frame radomes must be very sturdy and at the same time must hinder as little as possible the propagation of the electromagnetic waves.

Space frame radomes are known in the prior art, for instance from documents U.S. Pat. No. 4,946,736 and U.S. Pat. No. 700,605. A space frame radome is typically a rigid, self-supporting structure typically containing load bearing frames (i.e. rigid profiles connected to each other at their edges) and walls supported by the frame forming a geodesic shaped dome for enclosing and protecting an antenna. Typical materials for forming the frame of a space frame radome can include dielectrics, such as fiberglass, and metals, such as aluminum and steel. The frames typically have different geometries, such as a triangle. The wall of a space frame radome comprises typically an electromagnetically transmitting polymeric sheet supported by frames, the sheet typically being a fabric comprising polyester fibers in a polyester matrix, the fabric being coated with a hydrophobic coating or film, such as a fluoropolymer (PTFE). An example of such a sheet is ESSCOLAM®, which is a rigid sheet made of polyester fibers impregnated with a polyester resin and coated with a free standing film Tedlar®, which is a polyvinyl fluoride hydrophobic film. However, despite the fact that the known space frame radomes contain free standing additional hydrophobic layer(s) in the composition of the sheet forming the radome wall, the hydrophobicity of said radomes is still relatively low, while their manufacturing is more difficult and more costly due to additional layer(s) in the polymeric sheet. Furthermore, the electromagnetic transparency has lower values, also at lower thickness of the radome wall and their strength is lower, also at higher weight.

The objective of the present invention is therefore to obviate the above mentioned disadvantages known in the prior art by providing an improved space frame radome. An objective of the present invention is thus particularly to provide a space frame radome which attains higher hydrophobicity over a longer life time without the use of an additional hydrophobic material (e.g. as a coating or a film) in the sheet of the radome wall, thus posing less maintenance issues and being produced at lower costs. A further aim of the invention is to provide a space frame radome which is more durable (e.g. has higher tensile strength and/or modulus and/or lower elongation at break) as to resist to the strong stresses to which it is subjected during use, whereas at the same time has lighter weight and has higher transparency to the electromagnetic waves. Yet another aim of the invention is to provide a space frame radome that has a reduced dielectric loss over wide frequency bandwidths, e.g. from 0.5 GHz to at least 130 GHz.

This objective is achieved by a space frame radome comprising a sheet comprising high strength polymeric fibers and a plastomer, wherein said plastomer is a copolymer of ethylene or propylene and one or more C2 to C12 alpha-olefin co-monomers and has a density as measured according to ISO1183 of between 860 and 940 kg/m$^3$ and wherein the sheet has an areal density that is with at most 500% higher than the areal density of the high strength polymeric fibers.

It was observed that the space frame radome of the invention has higher hydrophobicity, even without the use of additional free standing hydrophobic material (e.g. as coating or film) in the sheet in the radome wall, is stronger (e.g. has higher tensile strength and/or modulus and/or lower elongation at break) as to resist to the high stresses to which it is subjected during use, whereas at the same time has lighter weight and has higher transparency to the electromagnetic waves. Moreover, it was observed that the space frame radome according to the invention has a reduced loss over wide frequency bandwidths, e.g. from 0.5 GHz to at least 130 GHz. In addition, said radome can be produced and maintained at lower costs and involve less maintenance difficulties.

By "sheet" is herein understood a flat body having a length, a width and/or a diameter much greater than thickness, as also typically known to the skilled person in the art. The width and the length of the sheet material are only limited by the practicalities, such as by production equipment; and by the size and shape of the space frame radome. The sheet may have a width of at least 200 mm, preferably at least 500 mm, more preferably at least 1000 mm, even more preferably at least 2000 mm, even more preferably at least 3000 mm, even more preferably at least 5000 mm and most preferably at least 10000 mm. The surface area of the sheet in a radome comprising three interconnected profiles may be at least 0.005 $m^2$, preferably at least 3 $m^2$, more preferably at least 10 $m^2$ and more preferably at least 15 $m^2$.

The sheet may be a multilayer sheet, wherein multiple layers can be the same or different materials. Preferably, the sheet in the space frame radome according to the present invention comprises at least one layer comprising high strength polymeric fibers, preferably at least one layer of an woven fabric, and at least one layer of plastomer, wherein said plastomer is a copolymer of ethylene or propylene and one or more C2 to C12 alpha-olefin co-monomer, the plastomer having a density as measured according to ISO1183 of between 860 and 940 kg/$m^3$ and wherein the sheet has an areal density that is with at most 500% higher than the areal density of the high strength polymeric fibers. The layer of plastomer may be a laminated layer (e.g. a film) or a coating and may have an average thickness of between 0.005 mm and 1 mm, preferably at least 0.007 mm, more preferably at least 0.01 mm, yet more preferably at least 0.02 mm; most preferably at least 0.04 mm and preferably at most 0.065 mm, more preferably at most 0.09 mm, yet more preferably at most 0.175 mm and most preferably at most 1 mm.

The sheet in the space frame radome according to the present invention is preferably flexible, being easier to transport, to handle and to install. By a flexible sheet is herein understood a sheet which may be folded or bended. A measure of the flexibility of said sheet may be when a sample of said sheet having a supported end, i.e. the end thereof which is placed on a rigid support such as a table; a free end, i.e. the unsupported end; and a length of 500 mm between the rigid support and the free end, will deflect under its own weight with an angle of preferably more than 3°, more preferably more than 10°, even more preferably of more than 30°, with respect to the horizontal.

The space framed radome according to the present invention is typically a self-supporting structure and comprises a radome wall formed by the sheet as defined herein and interconnected profiles, forming a geodesic shaped dome for enclosing and protecting an antenna, such as surveillance antenna. More preferably, the radome wall consists of the sheet and the interconnected profiles, wherein the sheet comprises high strength polymeric fibers and a plastomer, wherein said plastomer is a copolymer of ethylene or propylene and one or more C2 to C12 alpha-olefin co-monomers and the plastomer has a density as measured according to ISO1183 of between 860 and 940 kg/$m^3$ and wherein the sheet has an areal density that is with at most 500% higher than the areal density of the high strength polymeric fibers.

The interconnected profiles are typically load bearing frames that support (or fixate) the sheet and are connected to each other at their edges and are preferably rigid and may comprise extruded aluminium, metal or a low dielectric material. It should be noted that the term "rigid" as used herein defines a structure which will not, without modification, adapt to a shaped surface. The term "rigid material" as used herein is meant to encompass rigid materials, semi-rigid (partially flexible materials), and substantially any materials that are not or are partially flexible or elastic, i.e. that display no or very low elastic deformation (e.g. bending, stretching, twisting) under load. For instance, the rigid material can have a Young modulus of higher than 5, higher than 10, higher than 30, higher than 50, higher than 100 or higher than 200 GPa and up to 1000 GPa, as measured with ASTM E111-04 (2010). The interconnected profiles typically have different geometry, such as a triangle or polygon. By extruding aluminium, a relatively light profile with a desired shape can easily be made. Also other metals or low dielectric materials can be used and for example be extruded into the desired shape.

The sheet can easily be sized to fit all panel sizes and truncations of a metal space frame radome. The sheet can be attached in any way known in the art to the interconnected profiles to form the radome wall. For instance, such a fixation method is described in details in WO2014140260. A number of building elements comprising the profiles (frames) and the sheet can be for example made in advance and after which interconnected to form the radome wall. It is also possible to connect a number of sets of at least three interconnecting profiles to each other after which the sheet material is connected to each set of the profiles. Preferably, the clamping means are rigid and may contain a bolt and a nut system. Preferably, the rigid material of the clamping means is a metal selected from the group comprising steel, aluminium, bronze, brass, and the like. The building elements forming the radome wall may also be easily formed, e.g. by first attaching the profiles to each other to define an opening there between and thereafter mounting the sheet by connecting it to the profiles in order to cover said opening. The sheet material can be tensioned between the profiles, for example, by pulling on the edge of the sheet material, then locking the clamping means, and, if desired cutting the excess sheet material. It is also possible to attach the sheet material at the premises of the manufacturer prior to field use. After tensioning and locking, the excess sheet material may then be removed.

According to the invention, the sheet comprises high strength polymeric fibers. By "fiber" is herein understood at least one elongated body having a length much greater that its transverse dimensions, e.g. a diameter, a width and/or a thickness. The term fiber also includes e.g. a filament, a ribbon, a strip, a band, a tape, a film and the like. The fiber may have a regular cross-section, e.g. oval, circular, rectangular, square, parallelogram; or an irregular cross-section, e.g. lobed, C-shaped, U-shaped. The fiber may have continuous length, known in the art as filaments, or discontinuous lengths, known in the art as staple fibers. Staple fibers may be commonly obtained by cutting or stretch-breaking filaments. The fiber may have various cross-sections, e.g. regular or irregular cross-sections with a circular, bean-shape, oval or rectangular shape and they can be twisted or non-twisted. A yarn for the purpose of the invention is an elongated body containing a plurality of fibers. The skilled person may distinguish between continuous filament yarns or filament yarns which contain many continuous filament fibers and staple yarns or spun yarns containing short fibers also called staple fibers.

Suitable high strength polymeric fibers in the sheet comprised in the space frame radome according with the invention include, but are not limited to, fibers comprising polyolefins, such as homopolymers and/or copolymers of alpha-olefins, e.g. ethylene and/or propylene; polyoxymethylene; poly(vinylidine fluoride); poly(methylpentene); poly(ethylene-chlorotrifluoroethylene); polyamides and polyaramides, e.g. poly(p-phenylene terephthalamide) (known as Kevlar®); polyarylates; poly(tetrafluoroethylene) (PTFE); poly{2,6-diimidazo-[4,5b-4',5'e]pyridinylene-1,4(2,5-dihydroxy)phenylene} (known as M5); poly(p-phenylene-2,6-benzobisoxazole) (PBO) (known as Zylon®); poly(hexamethyleneadipamide) (known as nylon 6,6); polybutene; polyesters, e.g. poly(ethylene terephthalate), poly(butylene terephthalate), and poly(1,4 cyclohexylidene dimethylene terephthalate); polyacrylonitriles; polyvinyl alcohols and thermotropic liquid crystal polymers (LCP) as known from e.g. U.S. Pat. No. 4,384,016, e.g. Vectran® (copolymers of para hydroxybenzoic acid and para hydroxynaphtalic acid). Also combinations of fibers manufactured from such polymeric materials can be used for manufacturing said sheet. Preferably, the sheet comprise high strength polyolefin fibres, preferably alpha-polyolefins, such as propylene homopolymer and/or ethylene homopolymers and/or copolymers comprising propylene and/or ethylene.

Preferably, said high strength polymeric fibers are polyolefin fibers, more preferably polyethylene fibers. Good results may be obtained when the polyethylene fibers are high molecular weight polyethylene (HMWPE) fibers, more preferably ultrahigh molecular weight polyethylene (UHMWPE) fibers. Polyethylene fibers may be manufactured by any technique known in the art, preferably by a melt or a gel spinning process. If a melt spinning process is used, the polyethylene starting material used for manufacturing thereof preferably has a weight-average molecular weight between 20,000 g/mol and 600,000 g/mol, more preferably between 60,000 g/mol and 200,000 g/mol. An example of a melt spinning process is disclosed in EP 1,350,868 incorporated herein by reference. Most preferred polymeric fibers are gel spun UHMWPE fibers, e.g. those sold by DSM Dyneema under the name Dyneema®. By UHMWPE is herein understood a polyethylene having an intrinsic viscosity (IV) of at least 4 dl/g, more preferably at least 8 dl/g, most preferably at least 12 dl/g. Preferably said IV is at most 50 dl/g, more preferably at most 35 dl/g, more preferably at most 25 dl/g. Intrinsic viscosity is a measure for molecular weight (also called molar mass) that can more easily be determined than actual molecular weight parameters like $M_n$ and $M_w$. The IV may be determined according to ASTM D1601(2004) at 135° C. in decalin, the dissolution time being 16 hours, with BHT (Butylated Hydroxy Toluene) as anti-oxidant in an amount of 2 g/l solution, by extrapolating the viscosity as measured at different concentrations to zero concentration. When the intrinsic viscosity is too low, the strength necessary for using various molded articles from the UHMWPE sometimes cannot be obtained, and when it is too high, the processability, etc. upon molding is sometimes worsen. The average molecular weight ($M_w$) and/or the intrinsic viscosity (IV) of said polymeric materials can be easily selected by the skilled person in order to obtain fibers having desired mechanical properties, e.g. tensile strength. The technical literature provides further guidance not only to which values for $M_w$ or IV a skilled person should use in order to obtain strong fibers, i.e. fibers with a high tensile strength, but also to how to produce such fibers.

Preferably, the UHMWPE fibers are gel-spun fibers or melt-spun fibers, i.e. fibers manufactured with a gel-spinning process. Examples of gel spinning processes for the manufacturing of UHMWPE fibers are described in numerous publications, including EP 0205960 A, EP 0213208 A1, U.S. Pat. No. 4,413,110, GB 2042414 A, GB-A-2051667, EP 0200547 B1, EP 0472114 B1, WO 01/73173 A1 and EP 1,699,954.

In a special embodiment, the high strength polymeric fibers used in accordance to the invention have a tape-like shape, or in other words said polymeric fibers are polymeric tapes. Preferably, said polymeric tapes are UHMWPE tapes. A tape (or a flat tape) for the purposes of the present invention is a fiber with a cross sectional aspect ratio, i.e. ratio of width to thickness, of preferably at least 5:1, more preferably at least 20:1, even more preferably at least 100:1 and yet even more preferably at least 1000:1. The tape preferably has a width of between 1 mm and 600 mm, more preferable between 1.5 mm and 400 mm, even more preferably between 2 mm and 300 mm, yet even more preferably between 5 mm and 200 mm and most preferably between 10 mm and 180 mm. The tape preferably has a thickness of between 10 μm and 200 μm and more preferably between 15 μm and 100 μm. By cross sectional aspect ratio is herein understood the ratio of width to thickness.

Preferably, the polymeric fibers in the sheet of the space frame radome according to the present invention have a titer in the range of from 0.5 to 20 dpf, more preferably from 0.7 to 10, most preferably from 1 to 5 dpf. The yarns containing said fibers preferably has a titer in the range of from 100 to 3000, more preferably from 200 to 2500, most preferably from 400 to 2000 dtex, even most preferably between 500 and 1900 dtex.

By high strength fibers is understood herein fibers that have a high tensile strength, for instance of at least 0.5 GPa, as measured according to the method described in the METHODS OF MEASUREMENT section herein below. The tensile strength of said polymeric fibers is preferably at least 1.2 GPa, more preferably at least 2.5 GPa, most preferably at least 3.5 GPa. Preferably, the polymeric fibers are polyethylene fibers, more preferably UHMWPE fibers having a tensile strength of preferably at least 1.2 GPa, more preferably at least 2 GPa, preferably at least 3 GPa, yet even more preferably at least 3.5 GPa, yet even more preferably at least 4 GPa, most preferably at least 5 GPa. A space frame radome comprising a sheet comprising strong polyethylene fibers, such as HMWPE fibers or UHMWPE fibers has a better mechanical stability, is lighter in weight and stronger than any other radome having a similar construction but which contains fibers manufactured from e.g. polyester, nylon or aramid.

Preferably the high strength polymeric fibers have a tensile modulus of preferably at least 30 GPa, more preferably of at least 50 GPa, most preferably of at least 60 GPa. The tensile modulus of the fibers is measured according to the method described in the METHODS OF MEASUREMENT section herein below. Preferably, the high strength polymeric fibers are polyethylene fibers, more preferably UHMWPE fibers, wherein tensile modulus of the polyethylene fibers and in particular of the UHMWPE fibers is at least 50 GPa, more preferably at least 60 GPa, most preferably at least 80 GPa. It was observed that when such high strength polyethylene and more in particular such high strength UHMWPE fibers are used in accordance with the invention, the space frame radome of the invention It was observed that the space frame radome of the invention is stronger (e.g. has higher tensile strength and/or modulus and/or lower elongation at break) as to resist to the high stresses to which it is subjected during use, whereas at the same time has lighter weight and has higher transparency to the electromagnetic waves. Moreover, it was observed that the space frame radome according to the invention has a reduced loss over wide frequency bandwidths, e.g. from 0.5 GHz to at least 130 GHz.

In a preferred embodiment of the invention, at least 80 mass %, more preferably at least 90 mass %, most preferably about 100 mass % of the fibers comprised by the sheet are high strength polymeric fibers. More preferably, at least 80 mass %, more preferably at least 90 mass %, most preferably 100 mass % of the fibers contained by the sheet are polyethylene fibers and more preferably UHMWPE fibers. The remaining mass % of fibers may consist of other polymeric fibers as enumerated hereinabove. It was observed that by using a sheet containing an increased mass % of polyethylene fibers and in particular a sheet wherein all polymeric fibers are polyethylene fibers, the space frame radome of the invention may show a good resistance to sun light and UV degradation, high tear strength and low weight in addition to the advantages mentioned herein above, e.g. higher hydrophobicity and higher transparency to electromagnetic waves and reduced dielectric loss.

Preferably the high strength polymeric fibers contained by the sheet in the radome according to the invention is forming a fabric, i.e. said sheet contains a fabric comprising high strength polymeric fibers, preferably consisting of high strength polymeric fibers. Said fabric may be of any construction known in the art, e.g. woven, knitted, plaited, braided or non-woven or a combination thereof. Knitted fabrics may be weft knitted, e.g. single- or double-jersey fabric or warp knitted. An example of a non-woven fabric is a felt fabric or a fabric wherein the fibers run substantially along a common direction in a substantially parallel fashion. Further examples of woven, knitted or non-woven fabrics as well as the manufacturing methods thereof are described in "*Handbook of Technical Textiles*", ISBN 978-1-59124-651-0 at chapters 4, 5 and 6, the disclosure thereof being incorporated herein as reference. A description and examples of braided fabrics are described in the same Handbook at Chapter 11, more in particular in paragraph 11.4.1, the disclosure thereof being incorporated herein by reference.

Preferably, the fabric used in accordance to the invention is a woven fabric. Preferably said woven fabric is constructed with a small weight per unit length and overall cross-sectional diameter. Preferred embodiments of woven fabrics include plain (tabby) weaves, rib weaves, matt weaves, twill weaves, basket weaves, crow feet weaves and satin weaves although more elaborate weaves such as triaxial weaves may also be used. More preferably the woven fabric is a plain weave, most preferably, the woven fabric is a basket weave. Preferably, the fibers used to manufacture the woven fabric are tapes, more preferably they are fibers having a rounded cross-section, said cross section having preferably an aspect ratio of at most 4:1, more preferably at most 2:1. preferably a tape in the sheet according of the invention may be obtained by weaving. Weaving of tapes is known per se, for instance from document WO2006/075961, which discloses a method for producing a woven monolayer from tape-like warps and wefts comprising the steps of feeding tape-like warps to aid shed formation and fabric take-up; inserting tape-like weft in the shed formed by said warps; depositing the inserted tape-like weft at the fabric-fell; and taking-up the produced woven monolayer; wherein said step of inserting the tape-like weft involves gripping a weft tape in an essentially flat condition by means of clamping, and pulling it through the shed. The inserted weft tape is preferably cut off from its supply source at a predetermined position before being deposited at the fabric-fell position. When weaving tapes specially designed weaving elements are used. Particularly suitable weaving elements are described in U.S. Pat. No. 6,450,208. Preferably, the woven structure of the sheet is a plain weave. Preferably the weft direction in the sheet is under an angle with the weft direction in an adjacent monolayer. Preferably said angle is about 90°.

Preferably, the sheet comprised in the radome according to the present invention consists of high strength polymeric fibers and a plastomer, and optionally fillers and/or additives as described herein below, wherein said plastomer is a copolymer of ethylene or propylene and one or more C2 to C12 alpha-olefin co-monomers and wherein said plastomer has a density as measured according to ISO1183 of between 860 and 940 kg/m$^3$ and wherein the sheet has an areal density that is with at most 500% higher than the areal density of the high strength polymeric fiber. More preferably, the sheet comprised in the radome according to the present invention consists of high strength polymeric tapes, preferably high strength polymeric fabrics, more preferably high strength polymeric woven fabrics and a plastomer. Such preferred space frame radome shows higher hydrophobicity, even without the use of any additional free standing hydrophobic material (e.g. as coating or film) in the sheet in the radome wall and is stronger (e.g. has higher tensile strength and/or modulus and/or lower elongation at break) as to resist to the high stresses to which it is subjected during use, while showing higher transparency to the electromagnetic waves.

Preferably, the sheet contains a fabric, wherein the plastomer is impregnated throughout said fabric. The impregnation may be carried out in various forms and ways, for example by lamination or by forcing the plastomer through the yarns and/or the fibers of the fabric in e.g. a heated press. Examples of processes for the manufacturing of impregnated fabrics are disclosed for instance in U.S. Pat. Nos. 5,773,373; 6,864,195 and 6,054,178 included herein by reference. These processes can be routinely adapted for the materials, e.g. fibers, plastomer, utilized by the present invention.

The sheet in the radome according to the invention has an areal density (AD) that is with at most 500%, preferably with at most 400%, yet most preferably at most 300% and yet most preferably with at most 200% higher than the areal density of the high strength polymeric fibers, preferably than the AD of the high strength polymeric fibers being tapes or fabric, more preferably of the woven fabric, utilized therein. Good results may be obtained when the plastomer encapsulates the fabric which is preferably a woven fabric and the amount of plastomer was chosen as indicated hereinabove. AD is expressed herein in kg/m$^2$ and is obtained by weighing a certain area, e.g. 0.01 m$^2$ and dividing the obtained mass by the area of the sample.

Good results may be obtained when the plastomer has a tensile modulus of at most 0.6 GPa, more preferably of at most 0.4 GPa, most preferably of at most 0.2 GPa. Preferably, said plastomer has a tensile modulus of at least 0.01 GPa, more preferably of at least 0.05 GPa, most preferably of at least 0.1 GPa. The tensile modulus of the plastomer is measured according to the method described in the METHODS OF MEASUREMENT section herein below.

A preferred example of a sheet suitable for the invention is a sheet comprising woven fabrics comprising high strength polyethylene fibers, more preferably high strength UHMWPE fibers and which comprises a plastomer that is a copolymer of ethylene or propylene and one or more C2 to C12 alpha-olefin co-monomers and wherein said plastomer has a density as measured according to ISO1183 of between 860 and 940 kg/m$^3$ and wherein the sheet has an areal density that is with at most 500% higher than the areal density of the high strength polymeric fibers. Preferably, the plastomer impregnated woven fabrics contain polyethylene (e.g. UHMWPE) fibers and/or yarns. In addition to higher hydrophobicity and transparency to electromagnetic waves and reduced dielectric loss, such preferred fabrics show an excellent weight to strength ratio, they are lightweight and stronger than any (impregnated) fabric containing e.g. polyester, nylon, or aramid fibers.

Preferably, the sheet in the radome according to the present invention comprises: (i) a fabric, preferably a woven fabric, comprising yarns containing polyethylene fibers, preferably UHMWPE fibers; and (ii) a plastomer layer adhered to at least one surface of said woven fabric wherein said plastomer is a copolymer of ethylene or propylene and one or more C2 to C12 alpha-olefin co-monomers and wherein said plastomer has a density as measured according to ISO1183 of between 860 and 940 kg/m$^3$; and wherein the sheet has an areal density that is with at most 500% higher than the areal density of the high strength polymeric fibers. Such space frame radome shows higher hydrophobicity, even without the use of any additional free standing hydrophobic material (e.g. as coating or film) in the sheet in the radome wall and is stronger (e.g. has higher tensile strength and/or modulus and/or lower elongation at break) as to resist to the high stresses to which it is subjected during use, while showing higher transparency to electromagnetic waves.

Preferably, the sheet comprises: (i) a woven fabric comprising yarns containing polyethylene fibers, preferably UHMWPE fibers; and (ii) a plastomer layer having a first part adhered to one surface of said woven fabric and a second part impregnated between the yarns and/or the fibers of said fabric, the second part extending throughout said fabric and being cohesively connected to said first part; and wherein said plastomer is a copolymer of ethylene or propylene and one or more C2 to C12 alpha-olefin co-monomers and wherein said plastomer has a density as measured according to ISO1183 of between 860 and 940 kg/m$^3$ and wherein the sheet has an areal density that is with at most 500% higher than the areal density of the high strength polymeric fibers.

Preferably, the plastomer layer adheres to both surfaces of the woven fabric, therefore encapsulating said fabric. Preferably, the sheet comprises: (i) a woven fabric having an upper surface and a lower surface and comprising yarns containing polyethylene fibers, preferably UHMWPE fibers; and (ii) a plastomer layer encapsulating said fabric, said plastomer layer having a first part adhered to said upper surface; a third part adhered to said lower surface; and a second part which is impregnated between the yarns and/or the fibers of said fabric and extends throughout said fabric, said second part being cohesively connected to said first and third part of said plastomer layer; wherein said plastomer is a copolymer of ethylene or propylene and one or more C2 to C12 alpha-olefin co-monomers and wherein said plastomer has a density as measured according to ISO1183 of between 860 and 940 kg/m$^3$ and wherein the sheet has an areal density that is with at most 500% higher than the areal density of the high strength polymeric fibers.

Preferably, said second part is impregnated between both the yarns and the fibers. The second part of the plastomer layer also extends throughout said fabric meaning that the plastomer is distributed along the lateral dimensions of the fabric as well as along the vertical dimension of the fabric between the surfaces thereof. Preferably, the impregnation is carried out such that said second part of the plastomer layer extends along the vertical dimension from one surface of the fabric all the way to the opposite surface thereof.

By a plastomer layer adhered to a surface of a fabric is herein understood that the plastomer grips by physical forces to the fibers of the fabric with which it comes into contact. It is however not essential for the invention that the plastomer actually chemically bonds to the surface of the fibers. It was observed that the plastomer used according to the invention has an increased grip on e.g. the polyethylene fibers as compared with other types of thermoplastic materials. In a preferred embodiment the surface of the polyethylene fibers is corrugated, have protrusions or hollows or other irregular surface configurations in order to improve the grip between the plastomer and the fiber.

By two cohesively connected parts of the plastomer layer is herein understood that said parts are fused together into a single body such that preferably no line of demarcation is formed therein between and preferably no substantial variations of mechanical or other physical properties occur throughout the plastomer layer.

It also goes without saying that the terms "upper surface" and "lower surface" are merely used to identify the two surfaces which are characteristic to a woven fabric and should not be interpreted as actually limiting the woven fabric to facing a certain up or down positioning.

Preferred woven fabrics for use according to the invention are fabrics having a cover factor of at least 1.5, more preferably at least 2, most preferably at least 3, measured as indicated in the METHODS OF MEASUREMENT herein. Preferably, said cover factor is at most 30, more preferably at most 20, most preferably at most 10. It was observed that the use of such fabrics lead to an optimum impregnation of the woven fabric minimizing the amount of voids or air pockets contained by e.g. the sheet. It was furthermore observed that a more homogeneous sheet is obtained which in turn imparted the space frame radome of the invention with less local variations of its mechanical properties and better shape stability. The impregnation with a plastomer can be carried out for example by forcing under pressure the molten plastomer through said fiber and/or yarns.

The plastomer used in accordance with the invention is a plastic material that belongs to the class of thermoplastic materials and can be a semi-crystalline material. According to the invention, said plastomer is a copolymer of ethylene or propylene and one or more C2 to C12 alpha-olefin co-monomers, said plastomer having a density of between 860 and 940 kg/m$^3$ and wherein the sheet has an areal density that is with at most 500% higher than the areal density of the high strength polymeric fibers. Preferably, a single site catalyst polymerization process is applied, preferably said plastomer being a metallocene plastomer, i.e. a plastomer manufactured by a metallocene single site catalyst. Ethylene is in particular the preferred co-monomer in copolymers of propylene while butene, hexene and octene are being among the preferred alpha-olefin co-monomers for each ethylene and propylene copolymers.

In a preferred embodiment, said plastomer is a thermoplastic copolymer of ethylene or propylene and containing as co-monomers one or more alpha-olefins having 2-12 C-atoms, in particular ethylene, isobutene, 1-butene, 1-hexene, 4-methyl-1-pentene and 1-octene. When ethylene with one or more C3-C12 alpha-olefin monomers as co-monomers is applied, the amount of co-monomer in the copolymer usually is between 1 en 50 wt. %, and preferably between 5 and 35 wt %. In case of ethylene copolymers, the preferred co-monomer is 1-octene, said co-monomer being in an amount of between 5 wt % and 25 wt %, more preferably between 15 wt % and 20 wt %. In case of propylene copolymers, the amount of co-monomers and in particular of ethylene co-monomers, usually is lying between 1 en 50 wt. %, and preferably between 2 and 35 wt %, more preferably between 5 and 20 wt. %. Good results may be obtained when the density of the plastomer is between 880 and 920 kg/m$^3$, more preferably between 890 and 910 kg/m$^3$. The plastomer used according to the invention can have a DSC peak melting point as measured according to ASTM D3418 of between 70° C. and 120° C., preferably between 70° C. and 100° C., more preferably between 70° C. and 95° C.

A plastomer manufactured by a single site catalyst polymerization process and in particular a metallocene plastomer is distinguished from ethylene and propylene copolymers that have been manufactured with other polymerization techniques, e.g. Ziegler-Natta catalysts, by its specific density. Said plastomer also differentiates itself by a narrow molecular weight distribution, Mw/Mn, the values thereof preferably being between 1.5 en 3 and by a limited amount of long chain branching. The number of long chain branches preferably amounts at most 3 per 1000 C-atoms. Suitable plastomers that may be used in the sheet utilized in accordance with the invention and obtained with the metallocene catalyst type are manufactured on a commercial scale, e.g by Borealis, Exxon Mobil, Mitsui and DOW under brand names as Queo, Exceed, Vistamaxx, Tafmer, Engage, Affinity and Versify, respectively. A description of plastomers and in particular of metallocene-based plastomers as well as an overview of their mechanical and physical properties can be found for instance in Chapter 7.2 of "Handbook of polypropylene and polypropylene composites" edited by Harutun G. Karian (ISBN 0-8247-4064-5) and more in particular in subchapters 7.2.1; 7.2.2; and 7.2.5 to 7.2.7 thereof, which are included herein by reference.

It is also possible to use a plastomer comprising the plastomer used in accordance with the invention and additional thermoplastic materials and/or even other plastomer grades. Preferably, a blend containing the plastomer and a functionalized polyolefin are used in accordance with the invention. Preferably, the functionalized polyolefin is in an amount of between 1 wt % and 99 wt % of the blend weight, more preferably between 2.5 wt % and 50 wt %, more preferably between 5 wt % and 25 wt %. The functionalized polyolefin is preferably functionalized with a bifunctional monomer, the amount of the bifunctional monomer being between 0.1 wt % and 10 wt %, more preferably between 0.35 wt % and 5 wt %, most preferably between 0.7 wt % and 1.5 wt % of the weight of the polyolefin. Preferably, the polyolefin used for functionalisations is also a plastomer, more preferably said polyolefin is the plastomer used in accordance with the invention. Preferably, the polyolefin is functionalized with a bifunctional monomer such as maleicanhydride (MA) or vinyltrimethoxysilane (VTMOS). MA and VTMOS functionalized polyolefin's are commercially available products and the functionalization of the polyolefin may be carried out in accordance with known methods in the art, e.g. in an extrusion process, using peroxide as initiator. The advantage of using a functionalized polyolefin, preferably a functionalized plastomer is that the mechanical stability of the sheet used in accordance with the invention may be improved.

Preferably, the sheet used in accordance with the invention contains a fabric, more preferably a woven fabric, and the amount of plastomer is chosen to yield a sheet having an areal density (AD) that is with at least 20%, more preferably at least 50% higher than the AD of the fabric utilized therein.

The plastomer used in accordance with the invention may also contain various fillers and/or additives as defined hereinafter. In a preferred embodiment, the sheet comprises a woven fabric, a plastomer layer as defined hereinabove and optionally various fillers and/or additives as defined hereinafter added to the plastomer. Preferably, however, the plastomer is free of any filler and/or additive, i.e. contains 0 wt % filler and/or additive based on the total weight composition of the plastomer. It was observed that when the space frame radome of the invention comprises a sheet in accordance with this embodiment, said radome may show a higher transparency for electromagnetic waves and lower dielectric constant and loss tangent over brad frequency range.

Examples of fillers include reinforcing and non-reinforcing materials, e.g. calcium carbonate, clay, silica, mica, talcum, and glass. Examples of additives include stabilizers, e.g. UV stabilizers, pigments, antioxidants, flame retardants and the like. Preferred flame retardants include aluminum trihydrate, magnesium dehydrate, ammonium polyphosphate and others. The amount of flame retardants is preferably from 1 to 60 wt %, more preferably from 5 to 30 wt % based on the total amount of thermoplastic material, i.e. plastomer contained by the flexible support. Most preferred flame retardant is ammonium phosphate.

A sheet can be manufactured according to known methods in the art. Examples of such methods are disclosed in U.S. Pat. Nos. 5,773,373 and 6,054,178 included herein by reference. Preferably, the sheet is manufactured by a lamination method as for example the one disclosed in U.S. Pat. No. 4,679,519 included herein by reference, said method being routinely adapted to the materials used in the present invention.

Preferably, the average thickness of the sheet, which comprises said high strength polymeric fibers and said plastomer, is between 0.2 mm and 10 mm, More preferably, the average thickness of the sheet is at least 0.4 mm, yet more preferably at least 0.5 and most preferably at least 0.7 mm. Preferably, the average thickness of the sheet is at most 8 mm, more preferably at most 5 mm, yet more preferably at most 3 mm, and most preferably at most 1 mm. The AD of said sheet is preferably between 200 g/m$^2$ and 3000 g/m$^2$, more preferably between 200 g/m$^2$ and 2000 g/m$^2$. In case said sheet contains a fabric, its thickness is dependent upon the nature of the fabric and the thickness and the quantity of the plastomer.

When the sheet comprises a fabric and in particular a woven fabric which is encapsulated by the plastomer, said fabric can be positioned in the center of said sheet or off center. Good results may be obtained when the fabric was positioned as close as possible to the center of the sheet.

The sheet comprised in the space frame radome according to the invention may have a dielectric constant of lower than 3.20, preferably lower than 3, more preferably lower than 2.7, yet more preferably lower than 2.60 at a broad range frequency of between at least 0.5 GHz and at most 130 GHz as measured according to the method described in the METHODS OF MEASUREMENT section herein below.

The sheet in the space frame radome according to the invention may have a loss tangent of lower than 0.023, preferably lower than 0.02, more preferably lower than lower than 0.015, yet more preferably lower than 0.01, yet more preferably lower than 0.008, yet more preferably lower than 0.001, yet more preferably lower than 0.0009 at a broad range frequency of between at least 0.5 GHz and at most 130 GHz as measured according to the method described in the METHODS OF MEASUREMENT section herein below.

The sheet in the space frame radome according to the invention may have a contact angle higher than 84.5°, preferably at least 85°, yet more preferably at least 90° and most preferably at least 95°, and yet most preferably at least 98°, as measured according to the method described in the METHODS OF MEASUREMENT section herein below. This shows higher hydrophobicity of the space frame radome comprising the sheet as described herein above.

The space frame radome of the invention can be constructed according to known methods in the art, for instance as known from documents U.S. Pat. No. 4,946,736 and U.S. Pat. No. 700,605 and WO2014140260.

The present invention also relates to a process for manufacturing a space frame radome, preferably for manufacturing a space frame radome wall, said process comprising a step of attaching the sheet as described in the present patent application to interconnected profiles. Said process, interconnected profiles and the attachment step are also as described herein.

The present invention also relates to the sheet as described herein suitable for manufacturing of a space frame radome wall.

The invention also relates to a system comprising an antenna, preferably a surveillance antenna, and the space frame radome of the invention. By antenna is understood in the present invention a device capable of emitting, radiating, transmitting and/or receiving electromagnetic radiation.

Furthermore, the invention directs to the use of a sheet as described herein above, comprising high strength polymeric fibers and a plastomer, wherein said plastomer is a copolymer of ethylene or propylene and one or more C2 to C12 alpha-olefin co-monomers and wherein said plastomer has a density as measured according to ISO1183 of between 860 and 940 kg/m$^3$ for making a space frame radome, preferably for making a wall of a space frame radome, and wherein the sheet has an areal density that is with at most 500% higher than the areal density of the high strength polymeric fibers. By using said sheet in a space frame radome, the radome shows higher hydrophobicity, even without the use of any hydrophobic material (e.g. as coating or film) in the sheet in the radome wall, is stronger (e.g. has higher tensile strength and/or modulus and/or lower elongation at break) as to resist to the high stresses to which it is subjected during use, whereas at the same time has lighter weight, has higher transparency to the electromagnetic waves and shows better electromagnetic performance over a broad frequency range, i.e. has a reduced loss over wide frequency bandwidths, e.g. from 0.5 GHz to at least 130 GHz.

The invention may also relate to the use of the sheet as described herein for increasing hydrophobicity of a space frame radome. The invention may also relate to the use of the sheet as described herein for increasing the transparency for electromagnetic waves of a space frame radome. The invention may also relate to the use of the sheet as described herein for increasing electromagnetic performance of a space frame radome.

The invention will be further explained with the help of the following examples without being however limited thereto.

METHODS OF MEASUREMENT

IV: the Intrinsic Viscosity of UHMWPE is determined according to method PTC-179 (Hercules Inc. Rev. Apr. 29, 1982) at 135° C. in decalin, the dissolution time being 16 hours, with DBPC as anti-oxidant in an amount of 2 g/l solution, by extrapolating the viscosity as measured at different concentrations to zero concentration.

Cover factor: of a woven fabric is calculated by multiplying the average number of individual weaving yarns per centimeter in the warp and the weft direction with the square root of the linear density of the individual weaving yarns (in tex) and dividing by 10. An individual weaving yarn may contain a single yarn as produced, or it may contain a plurality of yarns as produced said yarns being assembled into the individual weaving yarn prior to the weaving process. In the latter case, the linear density of the individual weaving yarn is the sum of the linear densities of the as produced yarns. The cover factor (CF) can be thus computed according to formula:

$$CF = \frac{m}{10}\sqrt{pt} = \frac{m}{10}\sqrt{T},$$

wherein m is the average number of individual weaving yarns per centimeter, p is the number of as produced yarns assembled into a weaving yarn, t is the linear density of the yarn as produced (in tex) and T is the linear density of the individual weaving yarn (in tex).

Dtex: of a fiber was measured by weighing 100 meters of fiber. The dtex of the fiber was calculated by dividing the weight in milligrams by 10.

The electromagnetic properties, e.g. dielectric constant and dielectric loss, were determined for frequencies of 1.8 GHz to 10 GHz with the well-known Split Post Dielectric Resonator (SPDR) technique. For frequencies of above 10 GHz, e.g. of between 20 GHz and 130 GHz, the Open Resonator (OR) technique was used to determine said electromagnetic properties, wherein a classical Fabry-Perot resonator setup having a concave mirror and a plane mirror was utilized. For both techniques plane samples were used, i.e. samples not having any curvature in the plane defined by their width and length. In the case of SPDR technique, the thickness of the sample was chosen as large as possible being limited only by the setup design, i.e. the maximum height of the resonator. For the OR technique, the thickness of the sample was chosen to be an integer of about $\lambda/2$, wherein $\lambda$ is the wavelength at which the measurement is carried out. Since in the case of the SPDR technique, for each frequency at which the dielectric properties are measured a separate setup has to be utilized, the SPDR technique was carried out at the frequencies of 1.8 GHz; 3.9 GHz and 10 GHz. The setups corresponding to these frequencies are commercially available and were acquired from QWED (Poland) but are also sold by Agilent. The software delivered with these setups was used to compute the electromagnetic properties. For the OR technique, measurements were made at 35 GHz, 35.9 GHz and 50 GHz and the setup was built in accordance with the instructions given in Chapter 7.1.17 of "*A Guide to characterization of dielectric materials at RF and Microwave frequencies*" by Clarke, R N, Gregory, A P, Cannell, D, Patrick, M, Wylie, S, Youngs, I, Hill, G, Institute of Measurement and Control/National Physical Laboratory, 2003, ISBN: 0904457389, and all the references cited in that chapter, i.e. references 1-6, and in particular reference [3] R N Clarke and C B Rosenberg, "*Fabry-Perot and Open-resonators at Microwave and Millimeter-Wave Frequencies, 2-300 GHz", J. Phys. E: Sci. Instrum.,* 15, pp 9-24, 1982.

Tensile properties, i.e. strength and modulus, of polymeric fibers were determined on multifilament yarns as specified in ASTM D885M, using a nominal gauge length of the fibre of 500 mm, a crosshead speed of 50%/min and Instron 2714 clamps, of type Fibre Grip D5618C. For calculation of the strength, the tensile forces measured are divided by the titre, as determined by weighing 10 meters of fibre; values in GPa for are calculated assuming the natural density of the polymer, e.g. for UHMWPE is 0.97 g/cm$^3$.

Tensile properties of polymeric tapes: tensile strength and tensile modulus are defined and determined at 25° C. on tapes of a width of 2 mm as specified in ASTM D882, using a nominal gauge length of the tape of 440 mm, a crosshead speed of 50 mm/min.

Tensile modulus of thermoplastic materials (e.g. plastomer) was measured according to ASTM D-638(84) at 25° C.

Tensile properties (i.e. tensile strength and tensile modulus) of the sheets in Example and Comparative Experiment were measured according to ASTM D638-77, at a temperature of 25° C. and under ambient conditions and a sample thickness as indicated in Table 1 herein below.

Contact angle was determined by initially cleaning the surface of the samples (e.g. the fabrics obtained by Example and Comparative Experiment) with an alcohol, i.e. ethanol. Then a small droplet (preferably between 3 and 5 microliters) of water was added to the surface of the sample. The droplet size was 5 microliters in Example and Comparative Experiment. Subsequently, the contact angle between the droplet and the sample was measured using a microscope. This measurement can be repeated for at least 3 times (in Example and Comparative Experiment it was repeated 5 times) and the average value of the contact angle values obtained from the results of these measurements is presented in Table 1.

EXAMPLE AND COMPARATIVE EXPERIMENT

Example

A sheet was manufactured from a basket woven fabric having an AD of 0.193 kg/m$^2$, a thickness of about 0.60 mm and a width of about 2.75 m, and containing 880 dtex polyethylene yarns known as Dyneema® SK 65 which was impregnated with Queo 0203™, which is a plastomer commercially available from Borealis and is an ethylene based octene plastomer with about 18 wt % octene comonomer, a density of 902 kg/m$^3$ and a DSC peak melting point of 95° C. The plastomer was molten at a temperature of about 145° C. and discharged on a surface of the fabric. A pressure of about 45 bars was applied to impregnate the plastomer into the fabric at a temperature of about 120° C.

The above process was repeated in order to coat both surfaces of the woven fabric. The obtained sheet had a thickness of about 0.75 mm, an AD of 0.550 kg/m$^2$ and less than 40% voids. The AD of the sheet (radome wall) was 280% larger than the AD of the woven fabric. The plastomer layer was devised into: a first part of AD of about 0.175 kg/m$^2$ covering one surface of the fabric; a second part impregnated through the fabric between the yarns and fibers thereof; and a third part having an AD of about 0.175 kg/m$^2$ covering the other surface of the fabric. The results are presented in Table 1.

Comparative Experiment

An Esscolam-6™ sheet, commercially available from L-3 ESSCO was used. Esscolam-6™ sheet is a fabric made of polyester fibers impregnated with a polyester resin and coated with Tedlar® coating. Tedlar® is a polyvinyl fluoride hydrophobic film commercially available from DuPont. The results are presented in Table 1.

TABLE 1

| Properties | COMPARATIVE EXPERIMENT | Example 1 |
|---|---|---|
| Sheet thickness (mm) | 0.60 | 0.75 |
| Weight/area (kg/m$^2$) | 1.17 | 0.55 |
| Dielectric constant at 35 GHz | 3.28 | 2.56 |
| Loss tangent at 35 GHz | 0.023 | 0.0008 |

TABLE 1-continued

| Properties | COMPARATIVE EXPERIMENT | Example 1 |
|---|---|---|
| Tensile strength (MPa) (warp direction) | 155 | 315 |
| Tensile strength (MPa) (weft direction) | 119 | 275 |
| Tensile modulus (MPa) (warp direction) | 3447 | |
| Tensile modulus (MPa) (weft direction) | 3447 | |
| Contact angle (°) | 84.5 | 90 |

The results in Table 1 above show that, when compared to the known sheet, the sheet used in accordance with the invention shows better electromagnetic performance; greater tensile strength values, which results in a stronger space frame radome having higher transparency to electromagnetic waves; and better hydrophobicity over a longer life time without using any additional free standing hydrophobic coating, resulting in higher durability and easier maintenance of the radome wall.

The invention claimed is:

1. A space frame radome comprising a sheet, said sheet comprising high strength polymeric fibers and a plastomer, wherein said plastomer is a copolymer of ethylene or propylene and one or more C2 to C12 alpha-olefin comonomers and wherein said plastomer has a density as measured according to ISO1183 of between 860 and 940 kg/m$^3$ and wherein the sheet has an areal density that is with at most 500% higher than the areal density of the high strength polymeric fibers.

2. The space frame radome of claim 1, wherein the polymeric fibers are polyolefin fibers.

3. The space frame radome of claim 1, wherein the sheet has an areal density that is at most 300% higher than an areal density of the high strength polymeric fibers.

4. The space frame radome of claim 1, wherein the polymeric fibers are polyethylene fibers.

5. The space frame radome of claim 1, wherein the polymeric fibers are polymeric tapes.

6. The space frame radome of claim 1, wherein the polymeric fibers have a contact angle of higher than 84.5°.

7. The space frame radome of claim 1, wherein the sheet comprises a fabric selected from the group consisting of woven fabrics, knitted fabrics, plaited fabrics, braided fabrics, non-woven fabrics and combinations thereof.

8. The space frame radome of claim 1, wherein the sheet comprises a fabric and wherein the plastomer is impregnated throughout said fabric.

9. The space frame radome of claim 1, wherein the plastomer has a tensile modulus of at most 0.6 GPa.

10. The space frame radome of claim 1, wherein the plastomer is a copolymer of ethylene or propylene and one or more comonomers selected from the group consisting of ethylene, isobutene, 1-butene, 1-hexene, 4-methyl-1-pentene and 1-octene.

11. The space frame radome of claim 1, wherein the sheet has a thickness of between 0.2 mm and 10 mm.

12. The space frame radome according to claim 1, wherein the sheet has a dielectric constant of lower than 3.2 and a loss tangent of lower than 0.023, the dielectric constant and the loss tangent being measured at frequencies of between at least 0.5 GHz and at most 130 GHz.

13. The space frame radome of claim 4, wherein the polyethylene fibers are high molecular weight polyethylene (HMWPE) fibers.

14. The space frame radome of claim 4, wherein polyethylene fibers are ultrahigh molecular weight polyethylene (UHMWPE) fibers.

15. The space frame radome of claim 11, wherein the thickness of the sheet is between 0.3 and 1 mm.

16. A process for manufacturing the space frame radome according to claim 1, wherein the process comprises attaching the sheet to interconnected profiles.

17. A system comprising an antenna and the space frame radome of claim 1.

* * * * *